US005269269A

United States Patent [19]

Kreuter

[11] Patent Number: 5,269,269

[45] Date of Patent: Dec. 14, 1993

[54] ADJUSTING DEVICE FOR GAS EXCHANGE VALVES

[75] Inventor: Peter Kreuter, Aachen, Fed. Rep. of Germany

[73] Assignee: Audi AG, Fed. Rep. of Germany

[21] Appl. No.: 654,646

[22] PCT Filed: Jul. 28, 1989

[86] PCT No.: PCT/DE89/00492

§ 371 Date: Apr. 24, 1991

§ 102(e) Date: Apr. 24, 1991

[87] PCT Pub. No.: WO90/01615

PCT Pub. Date: Feb. 22, 1990

[30] Foreign Application Priority Data

Aug. 9, 1988 [DE] Fed. Rep. of Germany ..... 3826977

[51] Int. Cl.[5] ..... F01L 9/04

[52] U.S. Cl. ..... 123/90.11; 251/129.1

[58] Field of Search ..... 123/90.11; 251/129.01, 251/129.10

[56] References Cited

U.S. PATENT DOCUMENTS

| | | | |
|---|---|---|---|
| 4,455,543 | 6/1984 | Pischinger et al. | 335/266 |
| 4,841,923 | 6/1989 | Buchl | 123/90.11 |
| 5,076,222 | 12/1991 | Kawamura | 123/90.11 |

FOREIGN PATENT DOCUMENTS

| | | |
|---|---|---|
| 0889856 | 8/1981 | Belgium . |
| 0038128 | 10/1981 | European Pat. Off. . |
| 3024109 | 1/1982 | Fed. Rep. of Germany . |
| 0568216 | 3/1945 | United Kingdom . |

*Primary Examiner*—E. Rollins Cross
*Assistant Examiner*—Weilun Lo
*Attorney, Agent, or Firm*—Jacques M. Dulin; Thomas C. Feix

[57] ABSTRACT

An improved adjusting device for gas changing valves for use in internal combustion engines comprising a spring system and two electrically-operated, opposed actuating solenoids which are alternately excited to move a reduced mass actuator assembly back and forth therebetween and which is held at two discreet mutually-opposite operating positions. The improved actuator assembly comprises a reduced mass anchor plate which includes integrally attached upper and lower stems, which stems are guided through a co-aligned bore through both electromagnets. The lower stem includes a flange member which engages a flanged stamp end portion of a gas exchange valve stem to move the valve to either an open or closed position in response to the attraction of the anchor plate to a pole surface of an excited electromagnet. The upper and lower surfaces of the anchor plate are tapered from the middle to its outer edges to reduce the thickness and mass of the anchor plate. The pole surfaces of each electromagnet are correspondingly sloped to provide a contoured fit with the upper and lower impact surfaces of the anchor plate. The mass reduction in the anchor plate provides for shorter switching times of the actuator assembly while maintaining physical integrity of the anchor plate over long operating lifetimes.

6 Claims, 1 Drawing Sheet

ADJUSTING DEVICE FOR GAS EXCHANGE VALVES

FIELD

The invention is directed to an improved adjusting device for gas exchange valves in displacement engines of the type employing electromechanically-actuated, spring-biased reciprocating actuators, such as are commonly used for lifting valves of internal combustion engines. More particularly, the invention relates to a method and apparatus for improving the fast switching time behavior between the open and closed positions of gas exchange valves in an internal combustion engine whereby a pair of opposed electromagnetic devices are alternately excited to cause a reduced-mass, spring-biased anchor plate to reciprocate back and forth therebetween. The anchor plate is linked to the rod end of the gas exchange valve such that the engagement of the anchor plate with a pole surface of either electromagnet corresponds to the open or closed position of the gas exchange valve.

BACKGROUND

A similar type of valve adjusting device is known in principal from DE-OS 30 24 109 corresponding to U.S. Pat. No. 4,455,543 (Pischinger et al).

This known device discloses a gas exchange valve for an internal combustion engine wherein the valve stem is joined to a valve disk and includes a control element which is alternatingly moved by assistance of a spring system to two discrete operating positions and is retained thereat by either switching magnet, causing the valve to open or close. It is desirable to have improved fast switching time behavior in this type of system to optimize valve timing. Fast switching time behavior is defined as the shortness in time it takes the compression force of a spring to overcome a decaying electromagnetic force of a de-energized switching magnet in order to accelerate the control element to the other operating position.

Pischinger teaches to increase the operating frequency of the actuator assembly by reducing the masses to be accelerated. This is accomplished by connecting a uniformly thick armature to the control element (in this case a poppet valve) such that the armature is positioned between the two opposed switching magnets. Since the armature undergoes numerous cycles of pole surface impact over the operating life of the actuator assembly, the armature of this system must be sufficiently thick to withstand material fatigue and failure, thus the amount of mass that can be reduced to achieve improved time switching behavior is limited.

Other examples of solenoid actuated switching devices for gas exchange valves rely solely on electromagnetic means for providing the forces of motion for the valves.

GB 568 216 discloses an electromagnetically based positioning device for gas exchange valves, in which two opposed, push-pull type annular solenoid coils move a laminated iron field spool back and forth therebetween under alternating excitation. This motion is transmitted via a plunger to the valve disk of a gas exchange valve to open and close the valve. Each coil has provided along its inner annular surface an iron core which is tapered such that the inner annular surface forms a receiving socket for engagement with a correspondingly tapered side of the reciprocating field spool.

The coils lie against the lateral wall of a truncated cone, and the field spool is designed in such a way that it cannot be drawn freely into the coils, but instead the beveled faces of the field spool and the core form a stop piece. In order to transmit sufficient force, each core is heavy and massive, so that short switching times between the open and closed position cannot be achieved with a system of this kind.

BE-A 889 856 discloses a similar design, in which an armature having opposed conically shaped end faces is also moved into two axially arranged, alternately excited coils, interacting with a corresponding conical pole stopping face associated with each core. Once again, the core of each coil is heavy and clumsy, which prevents fast switching times of the system.

EP-A 38 128 is an example of a similar design for a solenoid actuated pilot spool valve using large mass elements but is directed toward use in hydraulic systems.

All of the above examples share the disadvantages of less than optimal fast switching time behavior due to the high mass designs of their moving elements i.e, armature, field spool, etc. Thus, there is a definite need in the art for solenoid actuated adjusting device for gas exchange valves in internal combustion engines which use moving elements of low mass design while ensuring the physical integrity of the moving elements and reliability and accuracy of the switching behavior over long operating lifetimes.

THE INVENTION

Objects

It is among the objects of the invention to provide an improved solenoid actuated, spring-biased, actuator assembly for gas exchange valves having the properties of improved (shorter or quicker) fast switching time behavior and reliable movement of the reciprocating anchor plate;

It is another object of the invention to reduce the switching times of the actuator assembly by providing an anchor plate of reduced mass wherein the anchor plate is tapered from its axial middle to its radial edges so that the inertia of the moving parts of the actuator assembly is reduced and the necessary retention force associated with each electromagnet is decreased;

It is another object of the invention to provide an improved actuator assembly wherein the opposed electromagnets are provided with pole surfaces having anchor plate impact surfaces which are adapted to conformingly engage a corresponding surface of an irregular shaped, reduced-mass anchor plate and whereby the conforming impact surfaces of the electromagnets cooperate with the reduced mass anchor plate to insure continued physical integrity of the anchor plate over long operating lifetimes; and Still other objects will be evident from the following description, drawings and claims.

DRAWINGS

SUMMARY

Figure 1:
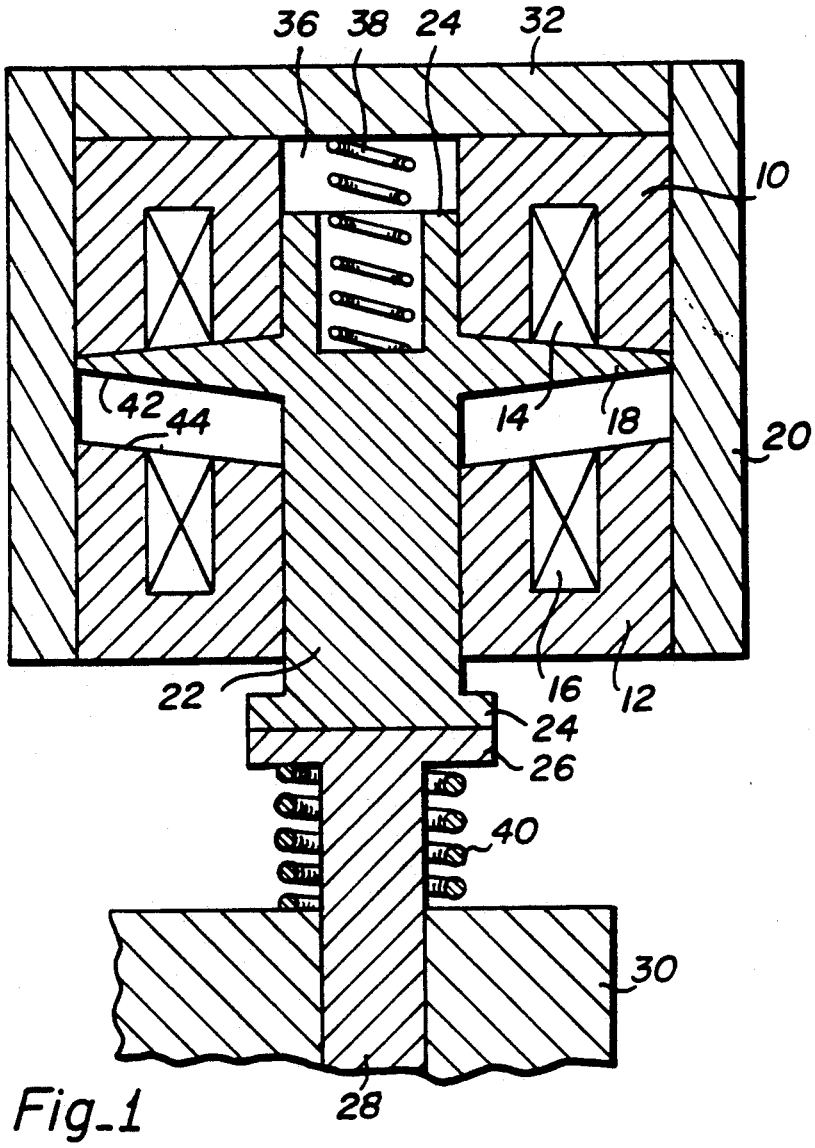
FIG. 1 is a side elevation view, in partial cross-section, of the improved actuator assembly of this invention.

The objects of the invention are achieved by providing a specially designed and configured anchor plate of reduced mass so that the total inertia of the actuator assembly of the invention is reduced thus allowing for shorter switching times (or increased frequency) of the valve actuator assembly. The actuator assembly of this invention is particularly suited for electromagnetically-actuated positioning mechanisms for spring loaded valve actuator assemblies in displacement engines. The overall positioning or adjusting mechanism has a spring system and two electrically-operated, opposed actuating solenoids. By alternately energizing the solenoids, the actuator assembly may be moved back and forth there between, and held at two discreet mutually-opposite operating positions, corresponding to the valve open and valve closed positions.

The opposing electromagnets are annular in cross-section and have a common axial bore which serves to guide the actuator assembly therein. The actuator assembly comprises the anchor plate which includes integral upper and lower stems (protrusions), the upper stem being receivingly engaged by the bore associated with the upper electromagnet and lower stem being receiving engaged by the co-aligned bore of the lower electromagnet.

The anchor plate functions as an armature between the two electromagnets. One spring is allocated to the upper stem and is stressed to move the anchor plate towards the opposing (lower) electromagnet. The lower stem also includes a flange member at its lower end which engages a stamp portion (disc-like end flange) of a gas exchange valve. Thus a downward depression by the flange member of the lower stem against the stamp portion of the gas exchange valve moves the valve to the open position. A second lower spring acts on both the stamp portion of the gas exchange valve and the lower stem flange to move the anchor plate to the upper electromagnet and hence moves the gas exchange valve to the closed position.

A mass reduction in the actuator assembly is achieved by reducing the thickness of the anchor plate along its region of contact (or impact) with the pole surface of each electromagnet.

In the preferred embodiment the thickness of the anchor plate is decreased by a gentle tapering of the upper and lower surfaces of the anchor plate starting from the region adjacent each stem and extending to the outer perimeter edge of the armature plate. Thus the anchor plates cross-section is somewhat trapezoidal. The pole surfaces of each electromagnet are correspondingly tapered to conformingly fit to the tapered upper and lower surfaces of the anchor plate.

The overall inertia of the moving parts of the actuator assembly is greatly reduced as the mass to be accelerated by the spring system is concentrated about the axial center of the actuator assembly. I have found that a mass reduction achieved by tapering the anchor plate by an angle of from about 2 to about 14 degrees to produce the sloping upper and lower surfaces, combined with the design of correspondingly sloped pole surfaces of the electromagnets, permits significantly faster switching time behavior of the actuator assembly while retaining the physical integrity of a uniformly thick anchor plate over long operating times.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

FIG. 1 illustrates an isolated view of an adjusting device for a gas exchange valve of the type normally found within the engine block of an internal combustion engine. The adjusting device comprises opposing shielded electromagnetics or iron cores 10 and 12. Each electromagnet is generally U-shaped in cross-section to form a cup magnet and has coils or solenoids 14 and 16 annularly installed therein. The solenoids 14, 16 are aligned parallel to the axis of the annulus coinciding with the axis of valve stem 28. Solenoid 14 is associated with electromagnet 10 and solenoid 16 is associated with electromagnet 12. Each electromagnet 10 and 12 also has pole surfaces 42 and 44, respectively associated therewith.

In the preferred embodiment, both electromagnets 10, 12 are cylindrical in shape and have a co-aligned centrally disposed bore 36 running along the vertical axis of the actuator assembly (i.e., the axis coordinate with that of the value stem 28). An anchor plate 18, being reciprocable in the vertical direction (as seen in the FIGURE), is provided and moves back and forth between pole surfaces 42 and 44. The anchor plate is provided with an upper stem 34 having an outer diameter sized to permit reciprocating travel within bore 36 associated with electromagnet 10 and a lower stem 22 having an outer diameter sized to permit reciprocating travel within bore 36 associated with electromagnet 12. Lower stem 22 also includes a flanged bottom end 24 which is disposed to engage the flange of stamp portion 26 of valve stem 28 which is associated with a gas exchange valve (not shown).

As there is no theoretical difference between intake and exhaust valve construction and opening/closing operation, the following discussion is generic to both types of gas exchange valves.

During the period that the excitement of solenoid 16 is caused to occur, anchor plate 18 is attracted towards pole surface 44 which causes flanged bottom end 24 to downwardly depress stamp 26 and hence moves the gas exchange valve to the open position. Conversely, as anchor plate 18 is attracted towards pole surface 42 (i.e., when solenoid 16 is de-energized and solenoid 14 is excited) then the gas exchange valve is moved to the closed position.

Upper and lower coil springs 20 and 28, respectively, being co-aligned with the central axis of the valve stem, are provided to bias the anchor plate 18 towards the opposing pole surface of the associated electromagnet upon cutting off the current to an adjacent electromagnet. Coil spring 38 is stressed to move the anchor plate 18 towards pole surface 44 and coil spring 40 is stressed to move anchor plate 18 towards pole surface 42.

As is seen in FIG. 1, coil spring 38 is constrained at its upper end by top abutment plate 32 and is disposed to be inserted in and received by a relieved central bore in the upper stem 34 at its bottom end. When solenoid 14 is de-energized and hence current through electromagnet 10 is cut off, the compression force of coil spring 38 overcomes the retention force of electromagnet 10 and forces the anchor plate 18 in a downward direction away from pole surface 42.

In a similar fashion, lower coil spring 40 abuts the underside of the top flanged surface of stamp 26 of the valve stem 28 at its top end and rests against cylinder block 30 at its bottom end. Coil spring 40, being compressed when solenoid 16 is excited and when anchor plate 18 contacts pole surface 44, forces anchor plate 18 in the upward direction away from pole surface 44 when solenoid 16 is de-energized. During non-excitation of solenoids 14 and 16, the neutral or dead center (locus) position of the spring system is about in the middle between the two pole surfaces 42 and 44, that is, anchor plate 18 comes to rest in the middle between the two pole surfaces 42 and 44. For more details on valve actuator assemblies directed to precise and simple adjustment of the valve stroke see my earlier issued U.S. Pat. No. 4,719,882.

The closed position of the gas exchange valve is as shown in the FIG. 1. Accordingly, the valve becomes opened upon a de-energization of solenoid 14 which is accompanied by an excitation of solenoid 16 whereby the anchor plate 18 is accelerated towards pole surface 44 by the compression force of spring 38.

An outer casing 20 provides a perimeter seal for the electromagnet and anchor plate assembly.

As is shown in the FIG. 1, the anchor plate 18 is not of a plane-parallel design, but rather has a thickness dimension which tapers from the middle radially outwardly to the edge region. By tapering the thickness of the anchor plate 18 in this manner, a reduction in mass is achieved which in turn reduces the inertia of the moving parts of the actuator assembly and hence provides for shorter (faster) switching times.

In the preferred embodiment, the anchor plate's cross-section is generally trapezoidal in the regions where it comes into contact with pole surfaces 42 and 44.

Significantly faster switching time behavior may be obtained through providing a reduced-mass anchor plate, being generally trapezoidal in cross-section, and wherein the radially outward sloping upper and lower surfaces of the anchor plate are angled (from the horizontal) in the range from about 2 to about 14 degrees.

It is preferable to begin the outward tapering of the anchor plate 18 at the region corresponding to the perimeter of bore 36, as this permits proper guidance of upper and lower stems 34 and 22 within upper and lower electromagnets 10 and 12 for the entire reciprocating path of movement of the anchor plate 18.

The pole surfaces 42 and 44 are appropriately equally angled to matingly receive the corresponding contact surface of the anchor plate 18 to ensure full contact.

Figure 2:
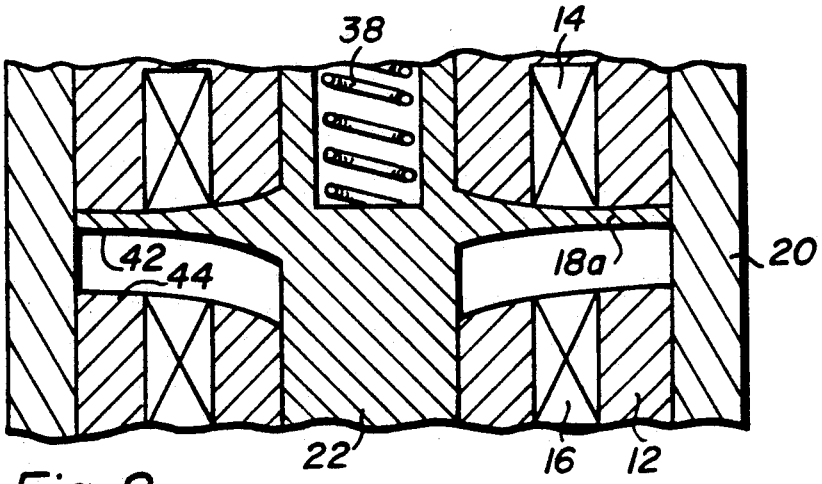
FIG. 2 is a fragmentory side elevation view, in partial cross-section of an alternate embodiment of the improved actuator assembly.

While it is shown in the FIG. 1 that the reduced mass anchor plate 18 of the invention is generally trapezoidal in cross-section and has a straight taper from its middle region to its edge, it is understood that the pole surface contact regions of the anchor plate may be configured in any of a number of different ways to achieve mass-reduction, including but not limited to a decreasing parabolic curvature of both the upper and lower pole surface contact regions of anchor plate as shown in FIG. 2. While such an irregular shaped configuration would necessitate a greater manufacturing effort for both the anchor plate and the electromagnets, it would allow for an optimized strength to weight ratio of the reduced mass anchor plate which in turn would further improve the fast switching time behavior of the actuator assembly.

It should be understood that various modifications within the scope of this invention can be made by one of ordinary skill in the art without departing from the spirit thereof. I therefore wish my invention to be defined by the scope of the appended claims as broadly as the prior art will permit, and in view of the specification if need be.

I claim:

1. An improved electromagnetically operated, spring-biased actuator assembly for gas exchange valves in internal combustion engines, comprising in operative combination:

a) a first actuating solenoid and a second actuating solenoid each having a pole face, said second actuating solenoid disposed opposite to and spaced from said first actuating solenoid to define a gap between said faces;

b) an anchor plate, disposed in said gap between said actuating solenoids and adapted to be selectively attracted to and guidingly reciprocated between alternate engagement with each of said actuating solenoids;

c) said anchor plate is generally disc shaped with a perimeter edge, and an upper surface and a lower surface;

d) said anchor plate includes:

i) an axially aligned center guide portion which is guidingly reciprocable within a common, co-aligned axial bore associated with each of said actuating solenoids;

ii) each of said upper and lower surfaces includes a solenoid contact portion extending between said center guide portion and said perimeter edge;

iii) said contact portion surfaces are contoured to engage said faces of said actuating solenoids; and iv) said guide stem includes means for contacting a coaxially aligned stamp member of a gas exchange valve stem to transfer reciprocating movement of said anchor plate to said gas exchange valve;

e) a spring system for symmetrically stressing said anchor plate and assisting said reciprocating movement upon the alternating excitation of said actuating solenoids; and f) said anchor plate disc has a thickness which decreases from said center guide portion to said perimeter edge to provide a strength to weight ratio which permits faster time switching behavior of said anchor plate as it reciprocates between alternate engagement with said actuating solenoids.

2. An improved electromagnetically operated, spring-biased actuator assembly for gas exchange valves as in claim 1 wherein:

a) said disc is tapered outwardly from said center guide portion to said perimeter edge;

b) said first actuating solenoid has a pole face which is contoured to conformingly receive said actuator contact portion upper surface; and c) said second actuating solenoid has a pole face which is contoured to conformingly receive said actuator contact portion lower surface.

3. An improved electromagnetically operated, spring-biased actuator assembly for gas exchange valves as in claim 2 wherein:

a) the angle of each said upper and lower surfaces forming said taper is substantially the same, and in the range from about 2 to about 14 degrees.

4. An improved electromagnetically operated, spring-biased actuator assembly for gas exchange valves as in claim 2 wherein:

a) said disc taper is curved on at least one surface.

5. An improved electromagnetically operated, spring-biased actuator assembly for gas exchange valve as in claim 4 wherein;

a) said curve is a parabola.

6. An improved electromagnetically operated, spring-biased actuator assembly for gas exchange valve as in claim 5 wherein;

a) both of said surfaces are parabolic curves.

* * * * *